US009116449B2

(12) United States Patent
Sakamoto et al.

(10) Patent No.: US 9,116,449 B2
(45) Date of Patent: Aug. 25, 2015

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Shinya Sakamoto, Kanagawa (JP); Satoshi Yoshida, Kanagawa (JP); Shinya Nakashima, Kanagawa (JP); Tetsuya Taguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 39 days.

(21) Appl. No.: 14/026,594

(22) Filed: Sep. 13, 2013

(65) Prior Publication Data

US 2014/0287353 A1 Sep. 25, 2014

(30) Foreign Application Priority Data

Mar. 25, 2013 (JP) ..... 2013-063022

(51) Int. Cl.

| | |
|---|---|
| ***G03G 9/087*** | (2006.01) |
| ***G03G 9/08*** | (2006.01) |
| ***G03G 9/093*** | (2006.01) |

(52) U.S. Cl.

CPC ..... *G03G 9/08755* (2013.01); *G03G 9/0827* (2013.01); *G03G 9/08782* (2013.01); *G03G 9/08795* (2013.01); *G03G 9/08797* (2013.01); *G03G 9/093* (2013.01)

(58) Field of Classification Search

CPC G03G 9/08755; G03G 9/08782; G03G 9/093
USPC ..... 430/108.4, 109.4
See application file for complete search history.

(56) References Cited

U.S. PATENT DOCUMENTS

| | | | | |
|---|---|---|---|---|
| 2001/0026899 | A1 | 10/2001 | Uchida et al. | |
| 2005/0245694 | A1 | 11/2005 | Matsumura et al. | |
| 2006/0204880 | A1* | 9/2006 | Mizutani et al. | 430/109.4 |
| 2007/0141498 | A1* | 6/2007 | Umehara | 430/108.21 |

FOREIGN PATENT DOCUMENTS

| | | |
|---|---|---|
| JP | A-2001-318484 | 11/2001 |
| JP | A-2002-278136 | 9/2002 |
| JP | A-2004-184561 | 7/2004 |

(Continued)

OTHER PUBLICATIONS

English language translation of JP 2013-137420 (Jul. 2013).*
Aoki, Takayoshi. "Chemical Toner Technology and the Future". IS&T's NIP19. Springfield, VA: The Society for Imaging Science and Technology. (2003) pp. 2-4.*

*Primary Examiner* — Christopher Rodee
(74) *Attorney, Agent, or Firm* — Oliff PLC

(57) ABSTRACT

An electrostatic charge image developing toner includes an amorphous polyester resin and a crystalline polyester resin as a binder resin, and by differential scanning calorimetry, which undergoes processes of a first temperature rise, cooling at a rate of −10° C./min and a second temperature rise, an endothermic peak (1) derived from a resin in which at least the amorphous polyester resin and the crystalline polyester resin are compatible is present in the first temperature rise, an exothermic peak having an intensity of 0.1 J/g or more is not present during the first temperature rise, and at least one exothermic peak (2) is present in a temperature range which is lower than that of the endothermic peak (1) by from 5° C. to 15° C. during the second temperature rise.

15 Claims, 4 Drawing Sheets

(56) References Cited

FOREIGN PATENT DOCUMENTS

| | | | |
|---|---|---|---|
| JP | A-2004-264803 | | 9/2004 |
| JP | A-2005-189808 | | 7/2005 |
| JP | A-2006-267965 | | 10/2006 |
| JP | A-2009-104193 | | 5/2009 |
| JP | 2013137420 | A * | 7/2013 |
| WO | WO 2013005856 | A1 * | 1/2013 |

* cited by examiner

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2013-063022 filed Mar. 25, 2013.

BACKGROUND

Technical Field

The present invention relates to an electrostatic charge image developing toner, an electrostatic charge image developer, and a toner cartridge.

SUMMARY

According to an aspect of the invention, there is provided an electrostatic charge image developing toner containing an amorphous polyester resin and a crystalline polyester resin as a binder resin, in which by differential scanning calorimetry, which undergoes processes of a first temperature rise, cooling at a rate of −10° C./min and a second temperature rise, an endothermic peak (1) derived from a resin in which at least the amorphous polyester resin and the crystalline polyester resin are compatible is present in the first temperature rise, an exothermic peak having an intensity of 0.1 J/g or more is not present during the first temperature rise, and at least one exothermic peak (2) is present in a temperature range which is lower than that of the endothermic peak (1) by from 5° C. to 15° C. during the second temperature rise.

BRIEF DESCRIPTION OF THE DRAWINGS

Exemplary embodiments of the present invention will be described in detail based on the following figures, wherein.

DETAILED DESCRIPTION

Figure 1:
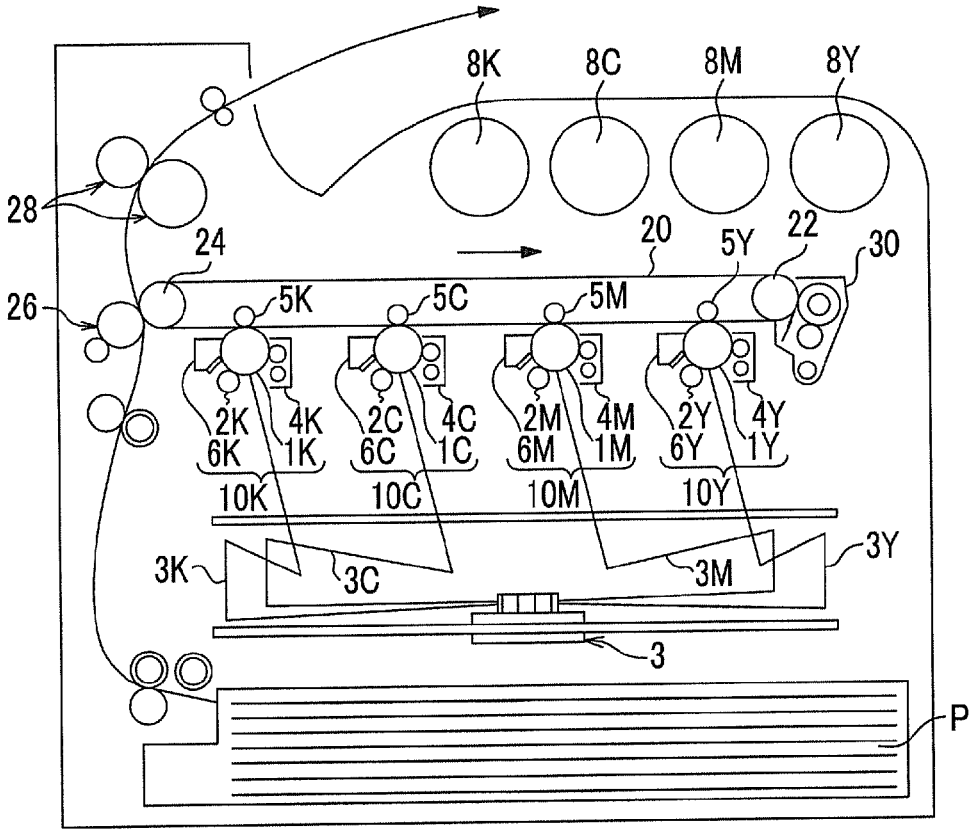
FIG. 1 shows a schematic configuration diagram of an image forming apparatus according to an exemplary embodiment.

A toner according to an exemplary embodiment will be described below in detail.

An electrostatic charge image developing toner according to the exemplary embodiment contains at least an amorphous polyester resin and a crystalline polyester resin as a binder resin. When differential scanning calorimetry (DSC), which undergoes processes of a first temperature rise, cooling at a rate of −10° C./min and a second temperature rise, is performed, an endothermic peak (1) derived from a resin in which at least the amorphous polyester resin and the crystalline polyester resin are compatible is present in the first temperature rise. In addition, an exothermic peak having an intensity of 0.1 J/g or more is not present during the first temperature rise. Further, during the second temperature rise, at least one exothermic peak (2) is present in a temperature range which is lower than that of the endothermic peak (1) by from 5° C. to 15° C.

Generally, in the toner containing a crystalline polyester resin, due to the compatibility of the crystalline polyester resin and the amorphous polyester resin, the melting temperature or softening temperature of a toner particle is decreased and high low-temperature fixing properties are realized. However, when the low-temperature fixing properties are excellent, the melting and softening temperature of a toner image after fixation is decreased so that remelting of the toner image after fixation occurs and an image defect occurs in some cases.

Particularly, when solid images are fixed on plural pieces of thick paper having a basis weight of 150 gsm or more and the like, cooling is not proceeded since the plural pieces of thick paper on which the solid images are fixed are stacked on a paper discharge tray and the thick paper maintains a high temperature for a long period of time. Therefore, as described above, when the toner containing the crystalline polyester resin which has high low-temperature fixing properties is used, the toner image is softened due to the latent heat of the thick paper and further, the weight of the thick paper, and the softened toner image is attached to other stacked thick paper. Therefore, an image defect occurs in some cases.

Contrarily, in the toner according to the exemplary embodiment, the endothermic peak (1) derived from a resin in which at least the amorphous polyester resin and the crystalline polyester resin are compatible is present in the first temperature rise, and the exothermic peak having an intensity of 0.1 J/g or more is not present during the first temperature rise. It is considered that a DSC curve by the first temperature rise exhibits the properties of toner particles before image fixation. That is, it is considered that the reason of the presence of the endothermic peak (1) and the absence of the exothermic peak is that the crystalline polyester resin and the amorphous polyester resin are compatible. Accordingly, in the toner according to the exemplary embodiment, it is assumed that the low-temperature fixing properties are realized.

In addition, it is considered that a DSC curve by the second temperature rise exhibits the properties of the toner image after image fixation. Since the exothermic peak (2) is present in the second temperature rise, it is considered that the crystalline polyester resin is crystallized alone and separated from the amorphous polyester resin. It is assumed that since the separation of the crystalline polyester resin from the amorphous polyester resin is promoted in the toner image after the fixation, the melting temperature or the softening temperature of the toner in the image are increased, thus, remelting of the toner image after the fixation is suppressed and an image defect is effectively suppressed from occurring.

Therefore, as described above, even when solid images are fixed on plural pieces of thick paper having a basis weight of 150 gsm or more and the like, the softening of the toner image is suppressed so as to prevent image defect occurrence due to the attachment of the toner image.

In addition, there is no particular limitation to a method of obtaining the toner in which the endothermic peak (1) derived from the resin in which at least the amorphous polyester resin and the crystalline polyester resin are compatible is present in the first temperature rise, the exothermic peak having an intensity of 0.1 J/g or more is not present during the first temperature rise, and the exothermic peak (2) is present in the second temperature rise, but a method of adding an additive that promotes the separation with the crystalline polyester resin in the production of the toner may be used.

The additive that promotes the separation will be described later.

Temperature Range of Exothermic Peak (2)

In addition, since the recrystallizing component of the separated crystalline polyester resin has higher heat resistance than that of the resin in which the amorphous polyester resin and the crystalline polyester resin are compatible by setting the temperature range such that the exothermic peak (2) is present in the temperature range which is lower than that of the endothermic peak (1) by from 5° C. to 15° C., effects of suppressing remelting of the toner image and preventing an image defect may be obtained.

When the temperature of the exothermic peak (2) is lower than that of the endothermic peak (1) and the temperature difference is less than 5° C., the crystallization of the separated crystalline polyester resin is not sufficient and thus, there is a disadvantage that an image defect occurs. On the other hand, when the temperature of the exothermic peak (2) is lower than that of the endothermic peak (1) and the temperature difference is more than 15° C., the crystallization temperature of the crystalline polyester resin is too low, and thus, there are disadvantages that remelting of the toner image occurs and an image defect occurs.

As a method of controlling the temperature range of the exothermic peak (2) to the above-described range, there is no particular limitation and adjustment of molecular weight in crystalline polyester resin, use of crystalline polyester resins having different melting temperatures, and the like may be adopted.

Differential Scanning Calorimetry (DSC)

8 mg of toner is weighed, the first temperature rise is performed from 0° C. to 150° C. at a temperature rising rate of 10° C./min using a differential scanning calorimeter (trade name: DSC-60A, manufactured by Shimadzu Corporation), and the temperature is maintained at 150° C. for 5 minutes. Next, rapid cooling is performed to 0° C. at a temperature falling rate of −10° C./min and the temperature is maintained at 0° C. for 5 minutes. Subsequently, the second temperature rise is performed from 0° C. to 150° C. at a temperature rising rate of 10° C./min.

Also, whether the endothermic peak (1) is derived from the resin in which the amorphous polyester resin and the crystalline polyester resin are compatible is determined by the following method.

Using a Soxhlet extractor, the amorphous polyester resin and the crystalline polyester resin are separated from each other and extracted. As a solvent, ethyl acetate is used. The crystalline polyester resin is condensed in a cooler and the amorphous polyester resin is dissolved and extracted in the solvent. A constituent monomer is identified by subjecting each extract to $^{1}$H-NMR measurement and hence, it is determined whether the extract is the crystalline polyester resin or the amorphous polyester resin. Then, the endothermic peak of the crystalline polyester resin alone is measured by the differential scanning calorimetry.

In addition, the intensity of the exothermic peak is calculated such that an arbitrary point of a flat part at a base line and a rising part of the exothermic peak, and an arbitrary point of a flat part at the base line and the falling part of the exothermic peak are specified on the DSC curve to determine an amount of heat of the exothermic peak using an analysis software for DSC-60A.

Moreover, the crystalline polyester resin is preferably a dehydrated polycondensate of aliphatic dicarboxylic acid having a carbon number of from 8 to 12 and aliphatic diol having a carbon number of from 6 to 12.

Dispersion unevenness of the crystalline polyester resin in the toner image is suppressed and image defect occurrence is more effectively suppressed by using the aliphatic dicarboxylic acid and aliphatic diol having carbon numbers in the above-described ranges.

The particularly preferable combination of the aliphatic dicarboxylic acid and the aliphatic diol is as follows.

Aliphatic dicarboxylic acid having a carbon number of 10 and aliphatic diol having a carbon number of 9

Aliphatic dicarboxylic acid having a carbon number of 10 and aliphatic diol having a carbon number of 6

Aliphatic dicarboxylic acid having a carbon number of 8 and aliphatic diol having a carbon number of 6

In addition, the toner according to the exemplary embodiment further contains a release agent, and the absolute value of difference in the melting temperature of the crystalline polyester resin and the melting temperature of the release agent is preferably 10° C. or less. The difference between the melting temperatures is more preferably 6° C. or less and even more preferably 3° C. or less.

It is considered that since the difference in the melting temperature of the crystalline polyester resin and the melting temperature of the release agent falls in the above-described range, at the time when the release agent bleeds on the surface of the toner image during the fixation, the crystalline polyester resin phase-separated from the amorphous polyester resin is also easily disposed on the surface of the toner image according to the bleeding of the release agent, which results in a greater effect of preventing an image defect.

Then, the method of measuring the melting temperature will be described later.

The toner according to the exemplary embodiment contains toner particles and an external additive as necessary.

Toner Particles

The toner particles contain, for example, a binder resin, and as necessary, a colorant, and a release agent and other additives.

In the exemplary embodiment, the toner contains at least an amorphous polyester resin and a crystalline polyester resin as the binder resin.

Binder Resin

Examples of the binder resin include vinyl-based resins made of homopolymers of monomers such as styrenes (for example, styrene, parachlorostyrene and α-methylstyrene), (meth)acrylic acid esters (for example, methyl acrylate, ethyl acrylate, n-propyl acrylate, n-butyl acrylate, lauryl acrylate, 2-ethylhexylacrylate, methyl methacrylate, ethyl methacrylate, n-propyl methacrylate, lauryl methacrylate and 2-ethylhexyl methacrylate), ethylenic unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone and vinyl isopropenyl ketone), and polyolefins (for example, ethylene, propylene and butadiene), and copolymers obtained by combining two or more kinds of these monomers.

Examples of the binder resin include non-vinyl-based resins such as epoxy resins, polyester resins, polyurethane resins, polyamide resins, cellulose resins, polyether resins, modified rosins, mixtures of the non-vinyl-based resins with the above vinyl-based resins, and graft copolymers obtained by polymerizing the above vinyl monomers under a coexistence of the above non-vinyl-based resins.

These binder resins may be used singly or in combination of two or more types.

As the binder resin, the polyester resins are preferable.

Examples of the polyester resins include known amorphous polyester resins. As the polyester resins, crystalline polyester resin may be used with the amorphous polyester resin. However, the crystalline polyester resin having a content in a range from 2% by weight to 40% by weight (preferably from 2% by weight to 20% by weight) with respect to the total amount of the binder resin may be preferably used.

Here, the term "crystalline" of resin means a resin not showing a stepwise change in an endothermic amount but having a clear endothermic peak in differential scanning calorimetry (DSC), and specifically, means that a half value width of an endothermic peak when measured at a temperature raising rate of 10 (° C./min) is within 10° C.

On the other hand, the term "amorphous" of resin means a resin showing a stepwise change in an endothermic amount and no recognized clear endothermic peak when the half value width is more than 10° C.

Amorphous Polyester Resin

An example of the amorphous polyester resin includes a condensation polymer of a polyvalent carboxylic acid and a polyol. In addition, as the amorphous polyester resin, commercially available products may be used, or synthetic resins may be used.

Examples of the polyvalent carboxylic acid include aliphatic dicarboxylic acids (for example, maleic acid, fumaric acid, succinic acid, alkyenyl succinic acid and adipic acid), alicyclic carboxylic acids (for example, cyclohexane dicarboxylic acid), aromatic dicarboxylic acids (for example, terephthalic acid, isophthalic acid, phthalic acid, and naphthalene dicarboxylic acid) and anhydrides and lower alkyl esters (for example, a carbon number of from 1 to 5) thereof. Among these polyvalent carboxylic acids, for example, aromatic carboxylic acids are preferably used.

As the polyvalent carboxylic acids, a trivalent or higher-valent carboxylic acid which has a crosslinked structure or a branched structure may be used with dicarboxylic acids. Examples of the trivalent or higher-valent carboxylic acid include trimellitic acid, pyromellitic acid, and anhydrides and lower alkyl esters (for example, having a carbon number of from 1 to 5) thereof.

These polyvalent carboxylic acids may be used singly or in combination of two or more types.

Examples of the polyols include aliphatic diols (for example, ethylene glycol, diethylene glycol, triethylene glycol, propylene glycol, butanediol, hexanediol, neopentyl glycol and glycerin), alicyclic diols (for example, cyclohexanediol, cyclohexanedimethanol and hydrogen-added bisphenol A) and aromatic diols (for example, ethylene oxide adducts of bisphenol A and propylene oxide adducts of bisphenol A). Among these polyols, for example, aromatic diols and alicyclic diols are preferably used, and aromatic diols are more preferably used.

As the polyols, a trivalent or higher-valent polyol which has a crosslinked structure or a branched structure may be used with diols. Examples of the trivalent or higher-valent polyol include glycerin, trimethylolpropane, and pentaerythritol.

These polyols may be used singly or in combination of two or more types.

The glass transition temperature (Tg) of the amorphous polyester resin is preferably from 50° C. to 80° C., and more preferably from 50° C. to 65° C.

In addition, the glass transition temperature is calculated from a DSC curve obtained from differential scanning calorimetry (DSC) and more specifically, the glass transition temperature is calculated according to "extrapolated glass transition starting temperature" described in a method of calculating glass transition temperature in "Testing methods for transition temperatures of plastics" of JIS K-1987.

The weight average molecular weight (Mw) of the amorphous polyester resin is preferably from 5,000 to 1,000,000, and more preferably from 7,000 to 500,000.

The number average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight average molecular weight and number average molecular weight are measured by gel permeation chromatography (GPC). The GPC molecular weight measurement is performed using GPC HLC-8120 (manufactured by Tosoh Corporation) as a measurement device and TSK gel Super HM-M (15 cm) (manufactured by Tosoh Corporation) as a column with THF as a solvent. The weight average molecular weight and number average molecular weight are calculated using a molecular weight calibration curve prepared using a monodispersed polystyrene standard sample from the measurement result.

The amorphous polyester resin may be produced using a known production method. Specifically, for example, there may be a method of preparing an amorphous polyester resin at a polymerization temperature in a range from 180° C. to 230° C. by reducing the pressure in the reaction system, as necessary, and reacting raw materials while removing water and alcohol generated during condensation.

In addition, when raw material monomers are not dissolved or compatible with each other at the reaction temperature, a solvent having a high boiling point may be added thereto as a dissolution aid, in order to dissolve the monomers. In this case, the polycondensation reaction is performed while distilling away the dissolution aid. When a monomer having a poor compatibility is present in the copolymerization reaction, the polycondensation reaction may be preferably performed with the main component after condensing the monomer having a poor compatibility with the acid or alcohol to be polycondensed with the monomer.

Crystalline Polyester Resin

An example of the crystalline polyester resin includes a polycondensation product of a polyvalent carboxylic acid and a polyol. In addition, as the crystalline polyester resin, commercially available products may be used, or synthetic resins may be used.

In order to easily form a crystal structure, a polycondensation product using a polymerizable monomer including linear aliphatic components is more preferable as the crystalline polyester resin than a polymerizable monomer including aromatic components.

Examples of the polyvalent carboxylic acid include aliphatic dicarboxylic acids (for example, oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid), aromatic dicarboxylic acids (for example, diacid such as phthalic acid, isophthalic acid, terephthalic acid, naphthalene-2,6-dicarboxylic acid, malonic acid, and mesaconic acid), and anhydrides or lower alkyl esters (having a carbon number of from 1 to 5) thereof.

As the polyvalent carboxylic acids, a trivalent or higher-valent carboxylic acid which has a crosslinked structure or a branched structure may be used with dicarboxylic acids.

Examples of the trivalent carboxylic acid include aromatic carboxylic acids (for example, 1,2,3-benzenetricarboxylic acid, 1,2,4-benzenetricarboxylic acid, and 1,2,4-naphthalenetricarboxylic acid) and the anhydrides or lower alkyl esters (for example, a carbon number of from 1 to 5) thereof.

As the polyvalent carboxylic acids, dicarboxylic acids having a sulfonate group and dicarboxylic acids having an ethylenic double bond may be used with dicarboxylic acids.

These polyvalent carboxylic acids may be used singly or in combination of two or more types.

Examples of the polyols include aliphatic diols (a linear aliphatic diol having a main chain carbon number in a range of from 7 to 20). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferable as the aliphatic diols.

As the polyols, a trivalent or higher-valent alcohol which has a crosslinked structure or a branched structure may be used with diols. Examples of the trivalent or higher-valent alcohol include glycerin, trimethylolethane, trimethylolpropane, and pentaerythritol.

The polyols may be used singly or in combination of two or more types.

In the polyols, the content of the aliphatic diol is preferably 80 mol % or more, and more preferably 90 mol % or more.

The melting temperature of the crystalline polyester resin is preferably in a range of from 50° C. to 100° C., more preferably in a range of from 55° C. to 90° C., and even more preferably in a range of from 60° C. to 85° C.

In addition, the melting temperature of the crystalline polyester resin is calculated from the DSC curve obtained from differential scanning calorimetry (DSC) according to a "melting peak temperature" described in a method of calculating melting temperature in "Testing methods for transition temperatures of plastics" of JIS K-1987.

The weight average molecular weight (Mw) of the crystalline polyester resin is preferably from 6,000 to 35,000.

For example, the crystalline polyester resin may be produced using a known production method as in the amorphous polyester.

For example, with respect to the total amount of the toner particles, the content of the binder resin is preferably from 40% by weight to 95% by weight, more preferably from 50% by weight to 90% by weight, and even more preferably from 60% by weight to 85% by weight.

Colorant

Examples of colorants include various kinds of pigments such as carbon black, chrome yellow, Hansa Yellow, Benzidine Yellow, Threne Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, Cu Pont Oil Red, Pyrazolone Red, Lithol Red, Rhodamine B Lake, Lake Red C, Pigment Red, Rose Bengal, Aniline Blue, Ultramarine Blue, Chalco Oil Blue, Methylene Blue Chloride, Phthalocyanine Blue, Pigment Blue, Phthalocyanine Green, and Malachite Green Oxalate, and various kinds of dyes such as acridine-based, xanthene-based, azo-based, benzoquinone-based, azine-based, anthraquinone-based, thioindigo-based, dioxazine-based, thiazine-based, azomethine-based, indigo-based, phthalocyanine-based, aniline black-based, polymethine-based, triphenylmethane-based, diphenylmethane-based and thiazole-based.

The colorants may be used singly or or in combination of two or more types.

Regarding the colorant, as necessary, a surface-treated colorant may be used and a dispersant may be used in combination. In addition, various kinds of colorants may be used in combination.

For example, the content of the colorant is preferably, for example, from 1% by weight to 30% by weight and more preferably from 3% by weight to 15% by weight with respect to the total amount of the toner particles.

Release Agent

Examples of the release agent include hydrocarbon-based wax; natural wax such as carnauba wax, rice wax and candelilla wax; synthetic or mineral and petroleum-based wax such as montan wax; and ester-based wax such as fatty acid ester and montanic acid ester. However, there is no limitation thereto.

The melting temperature of the release agent is preferably from 50° C. to 110° C. and more preferably from 60° C. to 100° C.

In addition, the melting temperature is calculated from the DSC curve obtained from differential scanning calorimetry (DSC) according to a "melting peak temperature" described in a method of calculating melting temperature in "Testing methods for transition temperatures of plastics" of JIS K-1987.

The content of the release agent is preferably, for example, from 1% by weight to 20% by weight and more preferably from 5% by weight to 15% by weight with respect to the total amount of the toner particles.

Separation Promoting Additive

In the exemplary embodiment, an additive that promotes separation may be preferably used with the crystalline polyester resin in the production of the toner.

Examples of the additive that promotes separation include sorbitan fatty acid esters. As the sorbitan fatty acid esters, sorbitan monostearate, sorbitan distearate, sorbitan tristearate, behenic monostearate, behenic distearate, behenic tristearate, sorbitan monopalmitate, sorbitan dipalmitate, sorbitan tripalmitate and the like may be used. Among these, sorbitan monostearate and behenic monostearate are preferable.

A method of adding the additive that promotes separation in the toner is not limited and for example, a method of adding an additive to a crystalline polyester resin dispersion may be used when the toner is produced in a wet production method. Specifically, the additive is added to the crystalline polyester resin dispersion prepared when the toner particles are produced, and emulsified with the crystalline polyester resin. It is preferable that the additive be added to the toner particles by using the emulsified crystalline polyester resin dispersion.

The added amount of the additive that promotes separation is preferably from 0.1% by weight to 3.0% by weight, more preferably from 0.2% by weight to 1.0% by weight, and even more preferably from 0.3% by weight to 0.8% by weight with respect to the crystalline polyester resin.

Other Additives

Examples of the other additives include known additives such as a magnetic material, a charge control agent, and an inorganic powder. These additives are contained in the toner particles as an internal additive.

Characteristics of Toner Particles and the Like

The toner particles may be toner particles having a single layer structure, or may be toner particles having a so-called core-shell structure constituted by a core portion (core particle) and a coating layer (shell layer) coating the core portion.

Here, the toner particles having a core-shell structure may be constituted by the core portion containing a binder resin, and, as necessary, other additives such as a colorant and a release agent, and the coating layer containing a binder resin.

For example, the volume average particle size (D50v) of the toner particles is preferably from 2 μm to 10 μm, and more preferably from 4 μm to 8 μm.

Various kinds of average particle sizes and particle size distribution indexes of the toner particles are measured using a COULTER MULTISIZER II (manufactured by Beckman Coulter, Inc.). ISOTON-II (manufactured by Beckman Coulter, Inc.) is used as an electrolyte.

In the measurement, 0.5 mg to 50 mg of a measurement sample is added to 2 ml of a 5% surfactant (sodium alkyl benzene sulfonate is preferable) aqueous solution as a dispersant. The mixture is added to 100 ml to 150 ml of the electrolyte.

The electrolyte in which the sample is suspended is subjected to a dispersion treatment for 1 minute by an ultrasonic dispersing machine, and the COULTER MULTISIZER II measures a particle size distribution of particles of from 2 μm to 60 μm by using an aperture having an aperture diameter of 100 μm. 50,000 particles are sampled.

On the basis of the particle size distributions measured in this manner, a cumulative distribution is drawn from the smallest diameter side for the volume and the number with respect to divided particle size ranges (channels). The particle sizes corresponding to 16% in the cumulative distributions are defined as a volume average particle size D16v and a number average particle size D16p, the particle sizes corresponding to 50% in the cumulative distributions are defined as a volume average particle size D50v and a number average particle size D50p, and the particle sizes corresponding to 84% in the cumulative distributions are defined as a volume average particle size D84v and a number average particle size D84p.

Using these particle sizes, a volume average particle size distribution index (GSDv) is calculated as $(D84v/D16v)^{1/2}$ and a number average particle size distribution index (GSDp) is calculated as $(D84p/D16p)^{1/2}$.

The shape factor SF1 of the toner particle is preferably from 110 to 150 and more preferably from 120 to 140.

Here, the shape factor SF1 is obtained by the following Equation.

Equation: $SF1=(ML^2/A)\times(\pi/4)\times 100$

In the equation, ML represents an absolute maximum length of the toner particle, and A represents a projected area of the toner particle.

Specifically, the shape factor SF1 is calculated as follows mainly using a microscopic image or an image of a scanning electron microscope (SEM) that is analyzed using an image analyzer to be digitalized. That is, an optical microscopic image of particles sprayed on the surface of a glass slide is scanned to an image analyzer LUZEX through a video camera, the maximum lengths and the projected areas of 100 particles are obtained for calculation using the above-described equation, and an average value thereof is obtained as SF1.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$ and $MgSO_4$.

It is advisable that the surfaces of the inorganic particles as the external additive are subjected to a hydrophobization treatment. For example, the hydrophobization treatment is performed by immersing the inorganic particles in a hydrophobization treating agent. The hydrophobization treating agent is not particularly limited and examples thereof include a silane coupling agent, silicone oil, a titanate coupling agent and an aluminum coupling agent. These may be used singly or in combination of two or more types.

For example, the amount of the hydrophobization treating agent is typically from 1 part by weight to 10 parts by weight with respect to 100 parts by weight of the inorganic particles.

Examples of the external additive also include resin particles (resin particles such as polystyrene, PMMA and melamine resin particles) and cleaning activators (for example, a metal salt of higher fatty acid represented by zinc stearate and a particle of a fluorine-based polymer).

The amount of the external additive externally added is, for example, preferably from 0.01% by weight to 5% by weight and more preferably from 0.01% by weight to about 2.0% by weight with respect to the toner particles.

Method of Producing Toner

Hereinafter, a method of producing a toner according to the exemplary embodiment will be described.

The toner according to the exemplary embodiment is obtained by externally adding an external additive to toner particles after the toner particles are produced.

The toner particles may be produced by any of a dry production method (for example, kneading and pulverization method) and a wet production method (for example, an aggregation and coalescence method, a suspension polymerization method and a dissolution suspension method). The method of preparing the toner particles is not limited thereto and a known method may be employed.

Among these, the toner particles are preferably obtained using an aggregation and coalescence method.

Specifically, for example, when the toner particles are produced using the aggregation and coalescence method, the toner particles are produced through a process of preparing a resin particle dispersion in which resin particles which become a binder resin are dispersed (resin particle dispersion preparing process), a process of forming aggregated particles by aggregating the resin particles (as necessary, other particles) in the resin particle dispersion (as necessary, in the dispersion after other particle dispersion is mixed) (aggregated particle forming process), and a process of forming toner particles by heating an aggregated particle dispersion in which the aggregated particles are dispersed to coalesce the aggregated particles (coalescing process).

Hereinafter, each process will be described in detail.

While a method of obtaining toner particles containing a colorant and a release agent will be described in the following description, the colorant and the release agent are used as necessary. Any additive other than colorants and release agents may, of course, be used.

Resin Particle Dispersion Preparing Process

First, along with a resin particle dispersion in which resin particles which become a binder resin are dispersed, for example, a colorant particle dispersion in which colorant particles are dispersed, and a release agent dispersion in which release agent particles are dispersed are prepared.

Herein, the resin particle dispersion is prepared, for example, by dispersing the resin particles in a dispersion medium by aid of a surfactant.

An example of the dispersion medium used in the resin particle dispersion includes an aqueous medium.

Examples of the aqueous medium include water such as distilled water and ion exchange water, and alcohols and the like. These may be used singly or in combination of two or more types.

Examples of the surfactant include anionic surfactants such as sulfuric ester salts, sulfonates, phosphoric esters and soap surfactants; cationic surfactants such as amine salts and quaternary ammonium salts; and nonionic surfactants such as polyethylene glycol, alkylphenol ethylene oxide adducts and polyols. Among these, particularly, anionic surfactants and cationic surfactants are preferable. The nonionic surfactants may be used in combination with anionic surfactants or cationic surfactants.

The surfactants may be used singly or in combination of two or more types.

In the exemplary embodiment, an amorphous polyester resin dispersion and a crystalline polyester resin dispersion are preferably prepared as resin particle dispersions. In addition, it is preferable that the additive that promotes separation be added to the crystalline polyester resin dispersion so that the dispersion is emulsified with the crystalline polyester resin.

In the resin particle dispersions, the resin particles may be dispersed in the dispersion medium by a general dispersion method, for example, by using a rotary shear type homogenizer, or a ball mill, a sand mill or a dynomill having media. Further, depending on the kind of resin particles, the resin particles may be dispersed in the resin particle dispersion, for example, by phase inversion emulsification.

The phase inversion emulsification is a method in which a resin to be dispersed is dissolved in a hydrophobic organic solvent capable of dissolving the resin, a base is added to the organic continuous phase (O phase) to neutralize the resin, an aqueous medium (W phase) is added to invert the resin into a discontinuous phase from W/O to O/W (so-called phase inversion), so that the resin may be dispersed in the form of particles in the aqueous medium.

The volume average particle size of the resin particles dispersed in the resin particle dispersions is preferably, for example, from 0.01 μm to 1 μm, more preferably from 0.08 μm to 0.8 μm, and even more preferably from 0.1 μm to 0.6 μl.

In addition, the volume average particle size of the resin particles is measured such that using the particle size distribution measured by a laser diffraction particle size distribution analyzer (LA-700, manufactured by Horiba Seisakusho Co., Ltd.), a cumulative distribution is drawn from the small diameter side with respect to the volume based on the divided particle size ranges (channels) and the particle size at which the cumulative volume distribution reaches 50% of the total particle volume is defined as a volume average particle diameter D50v. Hereinafter, the volume average particle size of particles in the other dispersion will be measured in the same manner.

For example, the content of the resin particles contained in the resin particle dispersion is preferably from 5% by weight to 50% by weight and more preferably from 10% by weight to 40% by weight.

For example, the colorant dispersion and the release agent dispersion may be prepared in a manner similar to the dispersion of resin particles. That is, with respect to the volume average particle diameter of the particles, the dispersion medium, the dispersion method and the content of the particles in the dispersion of the resin particles, the same is applied to the colorant particles dispersed in the colorant dispersion and the release agent particles dispersed in the release agent dispersion.

Aggregated Particle Forming Process

Next, along with the resin particle dispersion, the colorant particle dispersion and the release agent dispersion are mixed.

Then, in the mixed dispersion, the resin particles, the colorant particles and the release agent particles are heteroaggregated to form aggregated particles containing the resin particles, the colorant particles and the release agent particles, which have an approximately targeted particle size of the toner particle.

Specifically, for example, an aggregation agent is added to the mixed dispersion, and the pH of the mixed dispersion is adjusted to an acidic range (for example, from pH 2 to 5). As necessary, a dispersion stabilizer is added thereto, followed by heating to the glass transition temperature of the resin particles (specifically, from the temperature 30° C. lower than the glass transition temperature to the temperature 10° C. lower than the glass transition temperature of the specific polyester resin particles). The particles dispersed in the mixed dispersion are aggregated to form aggregated particles.

In the aggregated particle forming process, for example, the aggregation agent is added to the mixed dispersion while stirring using a rotary shear type homogenizer at room temperature (for example, 25° C.), and the pH of the mixed dispersion is adjusted to an acidic range (for example, from pH 2 to 5). As necessary, a dispersion stabilizer may be added thereto, followed by heating.

Examples of the aggregation agent include a surfactant having a polarity opposite to the polarity of the surfactant used as the dispersant which is added to the mixed dispersion, for example, an inorganic metal salt and a divalent or higher-valent metal complex. In particular, when a metal complex is used as an aggregation agent, the amount of the surfactant used is reduced, which results in improvement of electrostatic properties.

An additive capable of forming a complex or a similar bond with a metal ion in the aggregation agent may be used as necessary. As the additive, a chelating agent is suitable.

Examples of the inorganic metal salt include metal salts such as calcium chloride, calcium nitrate, barium chloride, magnesium chloride, zinc chloride, aluminum chloride and aluminum sulfate, and polymers of inorganic metal salts such as polyaluminum chloride, polyaluminum hydroxide and calcium polysulfide.

The chelating agent may be a water soluble chelating agent. Examples of the chelating agent include oxycarboxylic acids such as tartaric acid, citric acid and gluconic acid, iminodiacetic acid (IDA), nitrilotriacetic acid (NTA), and ethylenediaminetetraacetic acid (EDTA).

The amount of the chelating agent added is preferably from 0.01 part by weight to 5.0 parts by weight and more preferably 0.1 part by weight or more and less than 3.0 parts by weight with respect to 100 parts by weight of the resin particles.

Coalescing Process

Next, the aggregated particles are coalesced by heating the aggregated particle dispersion having the aggregated particles dispersed therein to, for example, the glass transition temperature of the resin particles or higher (for example, 10° C. to 30° C. higher than the glass transition temperature of the resin particles), to form toner particles.

The toner particles are obtained by the above-described processes.

Further, the toner particles may be produced by a process of forming second aggregated particles by obtaining an aggregated particle dispersion having the aggregated particles dispersed therein, further mixing the aggregated particle dispersion and the resin particle dispersion having the resin particles dispersed therein and performing aggregation so as to further attach the resin particles on the surface of the aggregated particles, and a process of coalescing the second aggregated particles by heating a second aggregated particle dispersion having the second aggregated particles dispersed therein to form toner particles having a core and shell structure.

After the coalescing process is completed, the toner particles formed in the solution are subjected to washing, solid-liquid separation and drying processes as known in the art to obtain dried toner particles.

The washing process may be preferably performed sufficiently by a replacement washing with ion exchange water in terms of electrostatic properties. The solid-liquid separation process is not particularly limited but may be preferably performed by filtration under suction or pressure in terms of productivity. The drying process is not particularly limited but may be preferably performed by freeze-drying, flash jet drying, fluidized drying or vibration fluidized drying in terms of productivity.

The toner according to the exemplary embodiment is produced, for example, by adding and mixing the external additive to the obtained dried toner particles. The mixing may be preferably performed by a V blender, a Henschel mixer, a Lodige mixer and the like. Further, as necessary, coarse particles may be removed using a vibration sieve or a wind classifier.

Electrostatic Charge Image Developer

The electrostatic charge image developer according to the exemplary embodiment is a developer including at least the toner according to the exemplary embodiment.

The electrostatic charge image developer according to the exemplary embodiment may be a single-component developer containing only the toner according to the exemplary embodiment, or may be a two-component developer containing a mixture of the toner and a carrier.

There is no particular limitation to the carrier and known carriers may be used. Examples of the carrier include a coated carrier in which the surface of a core made of a magnetic powder is coated with resin; a magnetic power dispersed carrier in which a magnetic powder is dispersed and blended in a matrix resin; a resin impregnated carrier in which a porous magnetic powder is impregnated with a resin; and a resin dispersed carrier in which conductive particles are dispersed and blended in a matrix resin.

The magnetic powder dispersed carrier, resin impregnated carrier and conductive particle dispersed carrier may be carriers each having the constitutional particle as a core and a coating resin coating the core.

Examples of the magnetic powder include magnetic metal such as iron oxide, nickel, or cobalt and a magnetic oxide such as ferrite magnetite.

Examples of the conductive particles include metal particles of gold, silver and copper and the like, and particles of carbon black, titanium oxide, zinc oxide, tin oxide, barium sulfate, aluminum borate, potassium titanate or the like.

Examples of the coating resin and matrix resin to be used in the carrier include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin containing an organosiloxane bond or a modified article thereof, a fluoro resin, polyester, polycarbonate, a phenol resin, and an epoxy resin.

Further, the coating resin and matrix resin may contain conductive materials and other additives and the like.

Here, in order to coat the surface of the core with the coating resin, a coating method using a coating resin and a coating layer forming solution in which various kinds of additives are dissolved in an appropriate solvent as necessary, may be used. The solvent is not limited and may be selected depending on a coating resin to be used and application suitability.

Specific examples of the resin coating method include an immersion method including immersing a core in a coating layer forming solution, a spray method including spraying a coating layer forming solution to the surface of a core, a fluidized-bed method including spraying a coating layer forming solution to a core while the core is suspended by a fluidizing air, and a kneader coater method including mixing a core of a carrier with a coating layer forming solution in a kneader coater, and then removing the solvent.

In the two-component developer, a mixing ratio (weight ratio) of the toner and the carrier is preferably toner:carrier=1:100 to 30:100, and more preferably 3:100 to 20:100.

Image Forming Apparatus and Method of Forming Image

Next, an image forming apparatus and a method of forming an image according to the exemplary embodiment will be described.

The image forming apparatus according to the exemplary embodiment includes an image holding member; a charging unit that charges the surface of the image holding member; an electrostatic charge image forming unit that forms an electrostatic charge image on a charged surface of the image holding member; a developing unit that accommodates an electrostatic charge image developer, and develops the electrostatic charge image formed on the surface of the image holding member as a toner image using the electrostatic charge image developer; a transfer unit that transfers the toner image formed on the surface of the image holding member onto the surface of a recording medium; and a fixing unit that fixes the toner image transferred onto the surface of the recording medium. As the electrostatic charge image developer, the electrostatic charge image developer according to the exemplary embodiment is used.

In the image forming apparatus according to the exemplary embodiment, there is carried out a method of forming an image (method of forming an image according to the exemplary embodiment) including charging the surface of an image holding member; forming an electrostatic charge image on a charged surface of the image holding member; developing the electrostatic charge image formed on the surface of the image holding member as a toner image using the electrostatic charge image developer according to the exemplary embodiment; transferring the toner image formed on the surface of the image holding member onto the surface of a recording medium; and fixing the toner image transferred onto the surface of the recording medium.

As the image forming apparatus according to the exemplary embodiment, known image forming apparatuses such as a direct transfer type image forming apparatus which directly transfers a toner image formed on the surface of an image holding member onto a recording medium; an intermediate transfer type image forming apparatus which primarily transfers a toner image formed on the surface of an image holding member onto the surface of an intermediate transfer body and secondarily transfers the toner image transferred on the surface of the intermediate transfer body onto the surface of a recording medium; an image forming apparatus including a cleaning unit which cleans the surface of an image holding member before charged after a toner image is transferred; and an image forming apparatus including an erasing unit which erases a charge from the surface of an image holding member before charged by irradiating the surface with easing light after a toner image is transferred may be used.

In the case of the intermediate transfer type image forming apparatus, for example, a transfer unit includes an intermediate transfer body in which a toner image is transferred onto the surface, a primary transfer unit which primarily transfers the toner image formed on the surface of the image holding member onto the surface of the intermediate transfer body, and a secondary transfer unit which secondarily transfers the toner image transferred onto the surface of the intermediate transfer body onto the surface of a recording medium.

In the image forming apparatus according to the exemplary embodiment, for example, a portion including the developing unit may have a cartridge structure (process cartridge) which is detachable from the image forming apparatus. As the process cartridge, a process cartridge which accommodates the electrostatic charge image developer according to the exemplary embodiment and is provided with the developing unit is suitably used.

Hereinafter, an example of the image forming apparatus according to the exemplary embodiment will be shown. However, there is no limitation thereto. In addition, main components shown in the drawing will be described, and the descriptions of the other components will be omitted.

FIG. 1 shows a schematic configuration diagram of an image forming apparatus.

The image forming apparatus shown in FIG. 1 includes first to fourth electrophotographic image forming units (image forming units) 10Y, 10M, 10C, and 10K which output images of the respective colors including yellow (Y), magenta (M), cyan (C), and black (K) on the basis of color-separated image data. These image forming units (hereinafter, also referred to simply as "units" in some cases) 10Y, 10M, 10C and 10K are arranged horizontally in a line with predetermined distances therebetween. Incidentally, each of these units 10Y, 10M, 10C and 10K may be a process cartridge which is detachable from the image forming apparatus.

Above each of the units 10Y, 10M, 10C and 10K in the drawing, an intermediate transfer belt 20 is provided and extends through each unit as an intermediate transfer body extending. The intermediate transfer belt 20 is provided around a drive roller 22 and a support roller 24 coming into contact with the inner surface of the intermediate transfer belt 20, which are separated from each other from left to right in the drawing. The intermediate transfer belt 20 travels in a direction from the first unit 10Y to the fourth unit 10K. Incidentally, the support roller 24 is biased in a direction away from the drive roller 22 by a spring or the like (not shown), such that tension is applied to the intermediate transfer belt 20 which is provided around the support roller 24 and the drive roller 22. Also, on the surface of the image holding member side of the intermediate transfer belt 20, an intermediate transfer body cleaning device 30 is provided opposing the drive roller 22.

Also, toners in the four colors of yellow, magenta, cyan and black, which are accommodated in toner cartridges 8Y, 8M, 8C and 8K, respectively, are supplied to developing devices (developing units) 4Y, 4M, 4C and 4K of the above-described units 10Y, 10M, 10C and 10K, respectively.

Since the first to fourth units 10Y, 10M, 10C, and 10K have the same configuration, the first unit 10Y, which is provided on the upstream side in the travelling direction of the intermediate transfer belt and forms a yellow image, will be described as a representative example. In addition, the same components as those of the first unit 10Y are represented by reference numerals to which the symbols M (magenta), C (cyan), and K (black) are attached instead of the symbol Y (yellow), and the descriptions of the second to fourth units 10M, 10C, and 10K, will be omitted.

The first unit 10Y includes a photoreceptor 1Y functioning as the image holding member. In the surroundings of the photoreceptor 1Y, there are successively disposed a charging roller 2Y (an example of the charging unit) for charging the surface of the photoreceptor 1Y to a predetermined potential; an exposure device 3 (an example of the electrostatic charge image forming unit) for exposing the charged surface with a laser beam 3Y on the basis of a color-separated image signal to form an electrostatic charge image; the developing device 4Y (an example of the developing unit) for supplying a charged toner into the electrostatic charge image to develop the electrostatic charge image; a primary transfer roller 5Y (an example of the primary transfer unit) for transferring the developed toner image onto the intermediate transfer belt 20; and a photoreceptor cleaning device 6Y (an example of the cleaning unit) for removing the toner remaining on the surface of the photoreceptor 1Y after the primary transfer.

The primary transfer roller 5Y is disposed inside the intermediate transfer belt 20 and provided opposite to the photoreceptor 1Y. Furthermore, bias power supplies (not shown), which apply primary transfer biases, are respectively connected to the respective primary transfer rollers 5Y, 5M, 5C and 5K. A controller (not shown) controls the respective bias power supplies to change the primary transfer biases which are applied to the respective primary transfer rollers.

Hereinafter, the operation of forming a yellow image in the first unit 10Y will be described.

First, before the operation, the surface of the photoreceptor 1Y is charged to a potential of −600 V to −800 V by the charging roller 2Y.

The photoreceptor 1Y is formed by stacking a photosensitive layer on a conductive substrate (volume resistivity at 20° C.: $1\times10^{-6}$ Ωcm or lower). In general, this photosensitive layer has high resistance (resistance similar to that of general resin), but has properties in which, when irradiated with the laser beam 3Y, the specific resistance of a portion irradiated with the laser beam changes. Therefore, the laser beam 3Y is output to the charged surface of the photoreceptor 1Y from the controller (not shown) through the exposure device 3 in accordance with yellow image data. The photosensitive layer on the surface of the photoreceptor 1Y is irradiated with the laser beam 3Y. As a result, an electrostatic charge image having a yellow printing pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charged charge flows on the surface of the photoreceptor 1Y and, in contrast, when the charge remains in a portion which is not irradiated with the laser beam 3Y.

The electrostatic charge image which is formed on the photoreceptor 1Y in this manner is rotated to a predetermined development position along with the travel of the photoreceptor 1Y. At this development position, the electrostatic charge image on the photoreceptor 1Y is visualized (developed) by the developing device 4Y.

The developing device 4Y accommodates, for example, the electrostatic charge image developer, which contains at least a yellow toner and a carrier. The yellow toner is frictionally charged by being stirred in the developing device 4Y to have a charge with the same polarity (negative polarity) as that of a charge charged on the photoreceptor 1Y and is maintained on a developer roller (as an example of the developer holding member). When the surface of the photoreceptor 1Y passes through the developing device 4Y, the yellow toner is electrostatically attached to a latent image portion at which the charge is erased from the surface of the photoreceptor 1Y, and the latent image is developed with the yellow toner. The photoreceptor 1Y on which a yellow toner image is formed subsequently travels at a predetermined rate, and the toner image developed on the photoreceptor 1Y is transported to a predetermined primary transfer position.

When the yellow toner image on the photoreceptor 1Y is transported to the primary transfer position, a predetermined primary transfer bias is applied to the primary transfer roller 5Y, an electrostatic force directed from the photoreceptor 1Y toward the primary transfer roller 5Y acts upon the toner image, and the toner image on the photoreceptor 1Y is transferred onto the intermediate transfer belt 20. The transfer bias applied at this time has a (+) polarity opposite to the polarity (−) of the toner. For example, the first unit 10Y is controlled to +10 μA by the controller (not shown).

Meanwhile, the toner remaining on the photoreceptor 1Y is removed and collected by the photoreceptor cleaning device 6Y.

Also, primary transfer biases to be applied respectively to the primary transfer roller 5M at the second unit 10M and thereafter, the primary transfer rollers 5C and 5K are controlled similarly to the primary transfer bias of the first unit.

In this manner, the intermediate transfer belt 20 having a yellow toner image transferred thereonto from the first unit 10Y is sequentially transported through the second to fourth units 10M, 10C and 10K, and toner images of respective colors are superposed and multi-transferred.

The intermediate transfer belt 20 having the four color toner images multi-transferred thereonto through the first to fourth units arrives at a secondary transfer portion which is configured with the intermediate transfer belt 20, the support roller 24 coming into contact with the inner surface of the intermediate transfer belt and a secondary transfer roller 26 (an example of the secondary transfer unit) disposed on the side of the image holding surface of the intermediate transfer belt 20. Meanwhile, a recording paper P (an example of the recording medium) is supplied to a gap at which the secondary transfer roller 26 and the intermediate transfer belt 20 are brought into press contact with each other at a predetermined timing through a supply mechanism and a predetermined secondary transfer bias is applied to the support roller 24. The transfer bias applied at this time has the same (−) polarity as the polarity (−) of the toner, and an electrostatic force directing from the intermediate transfer belt 20 toward the recording paper P acts upon the toner image, whereby the toner image on the intermediate transfer belt 20 is transferred onto the recording paper P. Incidentally, on this occasion, the secondary transfer bias is determined depending upon a resistance detected by a resistance detecting unit (not shown) for detecting a resistance of the secondary transfer portion, and the voltage is controlled.

Thereafter, the recording paper P is sent to a press contact portion (nip portion) of a pair of fixing rollers in a fixing device 28 (an example of the fixing unit), and the toner image is fixed onto the recording paper P to form a fixed image.

Examples of the recording paper P onto which the toner image is transferred include plain paper used for electrophotographic copying machines, printers and the like. As the recording medium, other than the recording paper P, OHP sheets may be used.

In order to improve the smoothness of the image surface after the fixing, the surface of the recording paper P is preferably smooth, and for example, coated paper in which the surface of plain paper is coated with a resin and the like, art paper for printing and the like are suitably used.

The recording paper P in which fixing of a color image is completed is transported to an ejection portion, whereby a series of the color image formation operations end.

Process Cartridge and Toner Cartridge

A process cartridge according to the exemplary embodiment will be described.

The process cartridge according to the exemplary embodiment includes a developing unit, which accommodates the electrostatic charge image developer according to the exemplary embodiment and develops an electrostatic charge image formed on an image holding member as a toner image using the electrostatic charge image developer, and is detachable from the image forming apparatus.

In addition, the configuration of the process cartridge according to the exemplary embodiment is not limited thereto and may include a developing device 111 and, additionally, one selected from other units such as an image holding member, a charging unit, an electrostatic charge image forming unit and a transfer unit as necessary.

Hereinafter, an example of the process cartridge according to the exemplary embodiment will be shown but the process cartridge is not limited thereto. Main parts shown in the drawing will be described and the descriptions of other parts will be omitted.

Figure 2:
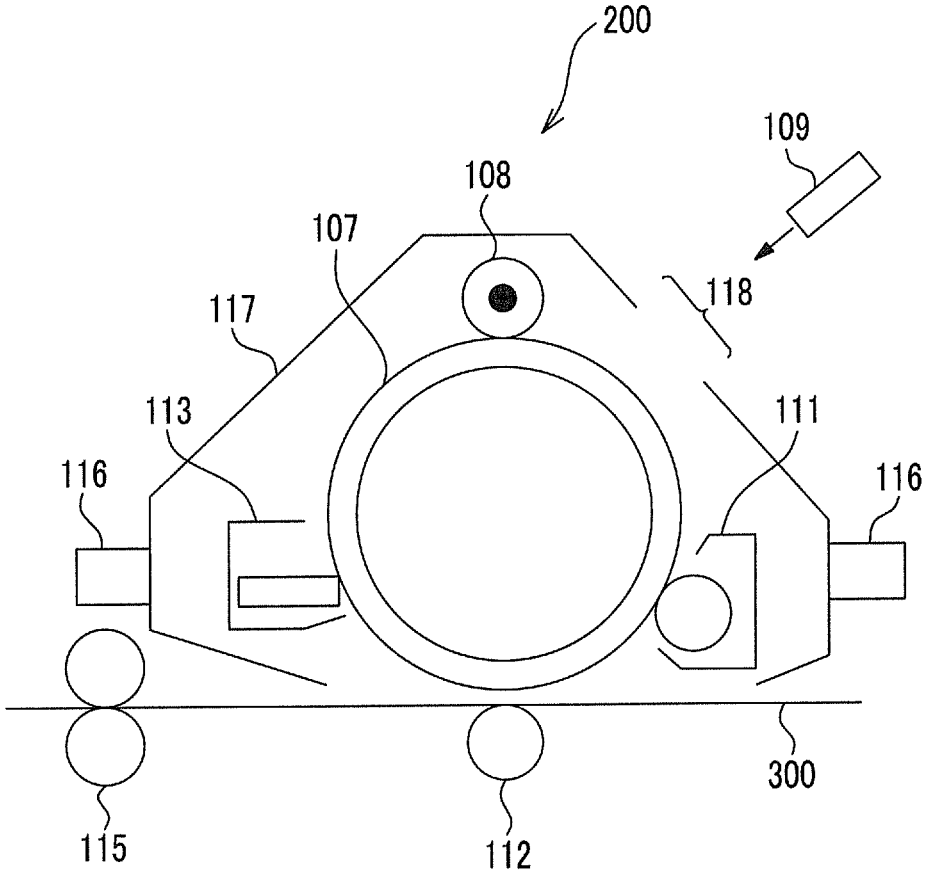
FIG. 2 shows a schematic configuration diagram of a process cartridge according to an exemplary embodiment.

FIG. 2 shows a schematic configuration diagram of the process cartridge according to the exemplary embodiment.

A process cartridge 200 shown in FIG. 2 includes, a photoreceptor 107 (an example of the image holding member), a charging roller 108 (an example of the charging unit) provided in the periphery of the photoreceptor 107, a developing device 111 (an example of the developing unit) and a photoreceptor cleaning device 113 (an example of the cleaning unit), all of which are integrally combined and supported, for example, by a chassis 117 provided with a mounting rail 116 and an opening portion 118 for exposure to form a cartridge.

Then, in FIG. 2, 109 denotes an exposure device (an example of the electrostatic charge image forming unit), 112 denotes a transfer device (an example of the transfer unit), 115 denotes a fixing device (an example of the fixing unit), and 300 denotes recording paper (an example of the recording medium).

Next, a toner cartridge according to the exemplary embodiment will be described.

The toner cartridge according to the exemplary embodiment is a toner cartridge which is detachable from the image forming apparatus and accommodates the electrostatic charge image developing toner according to the exemplary embodiment therein. The toner cartridge accommodates the electrostatic charge image developing toner for replenishment in order to supply the toner to the developing unit provided in the image forming apparatus.

The image forming apparatus shown in FIG. 1 is an image forming apparatus having a configuration in which the toner cartridges 8Y, 8M, 8C and 8K are detachably attached, and the developing devices 4Y, 4M, 4C, and 4K are connected to toner cartridges corresponding to the respective developing devices (colors) via a toner supply line (not shown). Also, in the case where the toner accommodated in the toner cartridge runs low, the toner cartridge is replaced.

EXAMPLES

The exemplary embodiments are more specifically described in detail below with reference to the following Examples and Comparative Examples, but it should be construed that the exemplary embodiments are not limited to these Examples. Incidentally, in the following description, "parts" and "%" represent "parts by weight", respectively unless otherwise indicated.

Preparation of Crystalline Polyester Resin Particle Dispersion (1)

Dodecanedioic acid dimethyl: 145 parts 1,9-Nonanediol: 72 parts

The aforementioned components are put in a flask and the temperature is increased to a temperature of 180° C. over 2 hours. After confirming that the inside of the reaction system is stirred uniformly, 0.8 part of titanium tetrabutoxide is added thereto. Further, the temperature is increased from the same temperature to 230° C. over 3 hours while removing the generated water, and the dehydration and condensation reaction is continued at 230° C. for further 2 hours, thereby obtaining a crystalline polyester resin (1) having a weight average molecular weight of 29,000.

Next, while maintaining the molten state, the polyester resin is mixed with 1.2 parts of sorbitan monostearate (manufactured by Wako Pure Chemical Industries, Ltd.) and transferred to a Cavitron CD 1010 (manufactured by EUROTEC LIMITED) at a rate of 35 g per minute. A diluted aqueous ammonia having a concentration of 0.33%, which is obtained by diluting aqueous ammonia as a test reagent with ion exchange water, is put in an aqueous medium tank which is separately provided, and under heating to 120° C. with a heat exchanger, is transferred to the Cavitron at a rate of 0.1 L per minute, simultaneously with the molten polyester resin. The Cavitron is operated at a rotation rate of a rotor of 60 Hz and a pressure of 5 kg/cm$^2$, thereby obtaining a crystalline polyester resin dispersion (1) having a solid content of 25.8%.

Preparation of Crystalline Polyester Resin Particle Dispersion (2)

Dodecanedioic acid dimethyl: 145 parts 1,6-Hexanediol: 68 parts

The aforementioned components are put in a flask and the temperature is increased to a temperature of 180° C. over 1.5 hours. After confirming that the inside of the reaction system is stirred uniformly, 0.8 part of titanium tetrabutoxide is added thereto. Further, the temperature is increased from the same temperature to 230° C. over 3 hours while removing the generated water, and the dehydration and condensation reaction is continued at 230° C. for further 2 hours, thereby obtaining a crystalline polyester resin (2) having a weight average molecular weight of 29,000.

Next, while maintaining the molten state, the polyester resin is mixed with 1.2 parts of sorbitan monostearate (manufactured by Wako Pure Chemical Industries, Ltd.) and transferred to a Cavitron CD 1010 (manufactured by EUROTEC LIMITED) at a rate of 35 g per minute. A diluted aqueous ammonia having a concentration of 0.33%, which is obtained by diluting aqueous ammonia as a test reagent with ion exchange water, is put in an aqueous medium tank which is separately provided, and under heating to 120° C. with a heat exchanger, is transferred to the Cavitron at a rate of 0.1 L per minute, simultaneously with the molten polyester resin. The Cavitron is operated at a rotation rate of a rotor of 60 Hz and a pressure of 5 kg/cm$^2$, thereby obtaining a crystalline polyester resin dispersion (2) having a solid content of 26.1%.

Preparation of Crystalline Polyester Resin Particle Dispersion (3)

Dodecanedioic acid dimethyl: 145 parts 1,6-Hexanediol: 68 parts

The aforementioned components are put in a flask and the temperature is increased to a temperature of 180° C. over 1.5 hours. After confirming that the inside of the reaction system is stirred uniformly, 0.6 part of titanium tetrabutoxide is added thereto. Further, the temperature is increased from the same temperature to 230° C. over 3 hours while removing the generated water, and the dehydration and condensation reaction is continued at 230° C. for further 5 hours, thereby obtaining a crystalline polyester resin (3) having a weight average molecular weight of 42,000.

Next, while maintaining the molten state, the polyester resin is mixed with 1.2 parts of sorbitan monostearate (manufactured by Wako Pure Chemical Industries, Ltd.) and transferred to a Cavitron CD 1010 (manufactured by EUROTEC LIMITED) at a rate of 35 g per minute. A diluted aqueous ammonia having a concentration of 0.33%, which is obtained by diluting aqueous ammonia as a test reagent with ion exchange water, is put in an aqueous medium tank which is separately provided, and under heating to 120° C. with a heat exchanger, is transferred to the Cavitron at a rate of 0.1 L per minute, simultaneously with the molten polyester resin. The Cavitron is operated at a rotation rate of a rotor of 60 Hz and a pressure of 5 kg/cm$^2$, thereby obtaining a crystalline polyester resin dispersion (3) having a solid content of 24.3%.

Preparation of Crystalline Polyester Resin Particle Dispersion (4)

Dodecanedioic acid dimethyl: 145 parts 1,6-Hexanediol: 68 parts

The aforementioned components are put in a flask and the temperature is increased to a temperature of 180° C. over 1.5 hours. After confirming that the inside of the reaction system is stirred uniformly, 1.0 part of titanium tetrabutoxide is added thereto. Further, the temperature is increased from the same temperature to 230° C. over 3 hours while removing the generated water, and the dehydration and condensation reaction is continued at 230° C. for a further 1 hour, thereby obtaining a crystalline polyester resin (4) having a weight average molecular weight of 15,000.

Next, while maintaining the molten state, the polyester resin is mixed with 1.2 parts of sorbitan monostearate (manufactured by Wako Pure Chemical Industries, Ltd.) and transferred to a Cavitron CD 1010 (manufactured by EUROTEC LIMITED) at a rate of 35 g per minute. A diluted aqueous ammonia having a concentration of 0.33%, which is obtained by diluting aqueous ammonia as a test reagent with ion exchange water, is put in an aqueous medium tank which is separately provided, and under heating to 120° C. with a heat exchanger, is transferred to the Cavitron at a rate of 0.1 L per minute, simultaneously with the molten polyester resin. The Cavitron is operated at a rotation rate of a rotor of 60 Hz and a pressure of 5 kg/cm$^2$, thereby obtaining a crystalline polyester resin dispersion (4) having a solid content of 27.3%.

Preparation of Crystalline Polyester Resin Particle Dispersion (5) (for Comparison)

A crystalline polyester resin particle dispersion (5) having a solid content of 25.5% is obtained in the same operations as in the preparation of the crystalline polyester resin particle dispersion (1) except that sorbitan monostearate, which is used in the preparation of the crystalline polyester resin particle dispersion (1), is not used.

Preparation of Crystalline Polyester Resin Particle Dispersion (6) (for Comparison)

Dodecanedioic acid dimethyl: 145 parts 1,6-Hexanediol: 68 parts

The aforementioned components are put in a flask and the temperature is increased to a temperature of 180° C. over 1.5 hours. After confirming that the inside of the reaction system is stirred uniformly, 0.5 part of titanium tetrabutoxide is added thereto. Further, the temperature is increased from the same temperature to 230° C. over 3 hours while removing the generated water, and the dehydration and condensation reaction is continued at 230° C. for further 6.0 hours, thereby obtaining a crystalline polyester resin (6) having a weight average molecular weight of 53,000.

Next, while maintaining the molten state, the polyester resin is mixed with 1.2 parts of sorbitan monostearate (manufactured by Wako Pure Chemical Industries, Ltd.) and transferred to a Cavitron CD 1010 (manufactured by EUROTEC LIMITED) at a rate of 35 g per minute. A diluted aqueous ammonia having a concentration of 0.33%, which is obtained by diluting aqueous ammonia as a test reagent with ion exchange water, is put in an aqueous medium tank which is separately provided, and under heating to 120° C. with a heat exchanger, is transferred to the Cavitron at a rate of 0.1 L per minute, simultaneously with the molten polyester resin. The Cavitron is operated at a rotation rate of a rotor of 60 Hz and a pressure of 5 kg/cm$^2$, thereby obtaining a crystalline polyester resin dispersion (6) having a solid content of 28.1%.

Preparation of Crystalline Polyester Resin Particle Dispersion (7)

Dodecanedioic acid dimethyl: 145 parts 1,6-Hexanediol: 68 parts

The aforementioned components are put in a flask and the temperature is increased to a temperature of 180° C. over 1.5 hours. After confirming that the inside of the reaction system is stirred uniformly, 1.3 parts of titanium tetrabutoxide is added thereto. Further, the temperature is increased from the same temperature to 230° C. over 3 hours while removing the generated water, and the dehydration and condensation reaction is continued at 230° C. for further 0.5 hour, thereby obtaining a crystalline polyester resin (7) having a weight average molecular weight of 10,000.

Next, while maintaining the molten state, the polyester resin is mixed with 1.2 parts of sorbitan monostearate (manufactured by Wako Pure Chemical Industries, Ltd.) and transferred to a Cavitron CD 1010 (manufactured by EUROTEC LIMITED) at a rate of 35 g per minute. A diluted aqueous ammonia having a concentration of 0.33%, which is obtained by diluting aqueous ammonia as a test reagent with ion exchange water, is put in an aqueous medium tank which is separately provided, and under heating to 120° C. with a heat exchanger, is transferred to the Cavitron at a rate of 0.1 L per minute, simultaneously with the molten polyester resin. The Cavitron is operated at a rotation rate of a rotor of 60 Hz and a pressure of 5 kg/cm$^2$, thereby obtaining a crystalline polyester resin dispersion (7) having a solid content of 29.4%.

Preparation of Amorphous Polyester Resin Dispersion

Bisphenol A ethylene oxide adduct: 52.1 parts

Bisphenol A propylene oxide adduct: 26.3 parts

Terephthalic acid: 20.2 parts

Dodecenyl succinic anhydride: 4.2 parts

Fumaric acid: 9.8 parts

The aforementioned components are put in a flask and the temperature is increased to a temperature of 200° C. over 2 hours. After confirming that the inside of the reaction system is stirred uniformly, 1.5 parts of dibutyltin oxide is added thereto. Further, the temperature is increased from the same temperature to 240° C. over 6 hours while removing the generated water, and the dehydration and condensation reaction is continued at 240° C. for further 5 hours, thereby obtaining an amorphous polyester resin (1) having a weight average molecular weight of 80,000.

Next, while maintaining the molten state, the polyester resin is transferred to a Cavitron CD 1010 (manufactured by EUROTEC LIMITED) at a rate of 40 g per minute. A diluted aqueous ammonia having a concentration of 0.33%, which is obtained by diluting aqueous ammonia as a test reagent with ion exchange water, is put in an aqueous medium tank which is separately provided, and under heating to 130° C. with a heat exchanger, is transferred to the Cavitron at a rate of 0.1 L per minute, simultaneously with the molten polyester resin. The Cavitron is operated at a rotation rate of a rotor of 60 Hz and a pressure of 5 kg/cm$^2$, thereby obtaining an amorphous polyester resin dispersion having a solid content of 40.1%.

Preparation of Pigment Dispersion

Carbon Black (R330, manufactured by Cabot Corporation): 70 parts

Anionic surfactant (DOWFAX 2A1, manufactured by Dow Chemical Company): 10 parts

Ion exchange water: 245 parts

The aforementioned components are mixed and dispersed using a homogenizer (ULTRA TURRAX T50, manufactured by IKA Works, Inc.) for 20 minutes, and then put in a circulating ultrasonic dispersing machine (RUS-600TCVP, manufactured by Nippon Seiki Co., Ltd.), thereby obtaining a pigment dispersion having a solid content of 21.3%.

Preparation of Release agent Dispersion (1)

Release agent (HNP 9, manufactured by Nippon Seiro Co., Ltd.): 80 parts

Anionic surfactant (DOWFAX 2A1, manufactured by Dow Chemical Company): 15 parts

Ion exchange water: 230 parts

The aforementioned components are mixed and dispersed using a homogenizer (ULTRA TURRAX T50, manufactured by IKA Works, Inc.) for 20 minutes, and then put in a circulating ultrasonic dispersing machine (RUS-600TCVP, manufactured by Nippon Seiki Co., Ltd.), thereby obtaining a release agent dispersion having a solid content of 25.1%.

Preparation of Release Agent Dispersion (2)

Release agent (WEP6, manufactured by NOF CORPORATION) 68 parts

Anionic surfactant (DOWFAX 2A1, manufactured by Dow Chemical Company): 15 parts

Ion exchange water: 187 parts

The aforementioned components are mixed and dispersed using a homogenizer (ULTRA TURRAX T50, manufactured by IKA Works, Inc.) for 20 minutes, and then put in a circulating ultrasonic dispersing machine (RUS-600TCVP, manufactured by Nippon Seiki Co., Ltd.), thereby obtaining a release agent dispersion having a solid content of 26.1%.

Preparation of Release Agent Dispersion (3)

Release agent (FNP0080, manufactured by Nippon Seiro Co., Ltd.): 74 parts

Anionic surfactant (DOWFAX 2A1, manufactured by Dow Chemical Company): 15 parts

Ion exchange water: 210 parts

The aforementioned components are mixed and dispersed using a homogenizer (ULTRA TURRAX T50, manufactured by IKA Works, Inc.) for 20 minutes, and then put in a circulating ultrasonic dispersing machine (RUS-600TCVP, manufactured by Nippon Seiki Co., Ltd.), thereby obtaining a release agent dispersion having a solid content of 25.5%.

Preparation of Release Agent Dispersion (4)

Release agent (FNP0085, manufactured by Nippon Seiro Co., Ltd.): 81 parts

Anionic surfactant (DOWFAX 2A1, manufactured by Dow Chemical Company): 15 parts

Ion exchange water: 198 parts

The aforementioned components are mixed and dispersed using a homogenizer (ULTRA TURRAX T50, manufactured by IKA Works, Inc.) for 20 minutes, and then put in a circulating ultrasonic dispersing machine (RUS-600TCVP, manufactured by Nippon Seiki Co., Ltd.), thereby obtaining a release agent dispersion having a solid content of 28.2%.

Example 1

Production of Toner Particles (1)

Crystalline polyester resin dispersion (1): 69.0 parts
Amorphous polyester resin dispersion: 122.2 parts
Colorant particle dispersion: 23.5 parts
Release agent dispersion (1): 31.0 parts
Surfactant (DOWFAX 2A1, manufactured by Dow Chemical Company): 7 parts
Ion exchange water: 1132.2 parts The aforementioned components are mixed and dispersed in a round-bottom stainless steel flask using a homogenizer (ULTRA TURRAX T50, manufactured by IKA Works, Inc.) so as to mix each component sufficiently. Then, 13 parts of 10% aluminum sulfate aqueous solution is added to the dispersion using a water bath and the content of the flask is stirred. After it is confirmed that the contents are dispersed uniformly, the resultant is stirred at a stirring rotation speed of 450 rpm by the use of a three-one motor (BLh300, manufactured by Shinto Scientific Co., Ltd.) and the resultant is heated and stirred to 42° C. at a temperature rising rate of 0.5° C./min and is retained at 42° C. for 60 minutes. Thereafter, 49.9 parts of amorphous polyester resin dispersion is additionally added thereto and the resultant is stirred for 60 minutes. By observing the resultant through the use of an optical microscope, it is confirmed that aggregated particles with a particle size of 6.1 μm are generated. 6.0 parts of 30% EDTA aqueous solution is added, and then, the pH is adjusted to 8.0 by the use of 0.8 M sodium hydroxide aqueous solution. Further, the temperature is increased to 95° C. and the aggregates are coalesced over 5 hours, cooled, filtrated, sufficiently washed with ion exchange water, and then dried, thereby obtaining toner particles (1) having a volume average particle size of 6.0 μm.

Production of Toner (1)

Commercially available fumed silica RX 50 (manufactured by Nippon Aerosil Co., Ltd., number average particle size D50: 40 nm) is prepared.

3 parts of the fumed silica RX 50 is added as an external additive to 100 parts of the obtained toner particles (1), the resultant is blended at a circumferential velocity of 45 m/s using a Henschel mixer for 10 minutes, and coarse particles are removed by using a sieve of 45 μm mesh, thereby obtaining a toner (1).

Production of Carrier

Ferrite Particles (volume average particle size: 35 μm) 100 parts
Toluene: 14 parts
Perfluorooctylethyl acrylate-methyl methacrylate copolymer (copolymerization ratio=2:8, weight average molecular weight: 77,000): 1.6 parts
Carbon black (trade name: VXC-72, manufactured by Cabot Corporation, volume resistivity: 100 Ωcm or less): 0.12 parts
Crosslinked melamine resin particles (average particle size: 0.3 μm, toluene-insoluble): 0.3 parts First, the carbon black is diluted with the toluene and the resultant is added to the perfluorooctylethyl acrylate-methyl methacrylate copolymer and dispersed using a sand mill. Next, the crosslinked melamine resin particles are added to the dispersion and dispersed by a stirrer for 10 minutes to form a coating layer forming solution. Next, the coating layer forming solution and the ferrite particles are put in a vacuum degassing kneader, stirred for 30 minutes at a temperature of 60° C., and then depressurized so as to distill away the toluene and form a resin coating layer, thereby obtaining a carrier.

Production of Developer (1)

After 16.1 parts of the toner (1) and 213.9 parts of the carrier are put in a 2 L V blender and stirred for 20 minutes, the mixture is sieved using a 212 μm mesh sieve, thereby producing a developer (1).

Example 2

Production of Toner Particles (2)

Toner particles (2) having a volume average particle size of 6.0 μm are obtained in the same operations as in the production of the toner particles (1) except that 30.0 parts of release agent dispersion (2) is used instead of the release agent dispersion (1).

Production of Toner (2)

A toner (2) is obtained in the same operations as in the production of the toner (1) except that the toner particles (2) are used instead of the toner particles (1).

Production of Developer (2)

A developer (2) is obtained in the same operations as in the production of developer (1) except that the toner (2) is used instead of the toner (1).

Example 3

Production of Toner Particles (3)

Toner particles (3) having a volume average particle size of 6.0 μm are obtained in the same operations as in the production of the toner particles (1) except that 69.8 parts of crystalline polyester resin dispersion (2) and 30.7 parts of release agent dispersion (3) are used instead of the crystalline polyester resin dispersion (1) and release agent dispersion (1), respectively.

Production of Toner (3)

A toner (3) is obtained in the same operations as in the production of the toner (1) except that the toner particles (3) are used instead of the toner particles (1).

Production of Developer (3)

A developer (3) is obtained in the same operations as in the production of developer (1) except that the toner (3) is used instead of the toner (1).

Example 4

Production of Toner Particles (4)

Toner particles (4) having a volume average particle size of 6.0 μm are obtained in the same operations as in the production of the toner particles (1) except that 27.6 parts of release agent dispersion (4) is used instead of the release agent dispersion (1).

Production of Toner (4)

A toner (4) is obtained in the same operations as in the production of the toner (1) except that the toner particles (4) are used instead of the toner particles (1).

Production of Developer (4)

A developer (4) is obtained in the same operations as in the production of developer (1) except that the toner (4) is used instead of the toner (1).

Example 5

Production of Toner Particles (5)

Toner particles (5) having a volume average particle size of 6.0 μm are obtained in the same operations as in the production of the toner particles (1) except that 74.1 parts of crystalline polyester resin dispersion (3) is used instead of the crystalline polyester resin dispersion (1).

Production of Toner (5)

A toner (5) is obtained in the same operations as in the production of the toner (1) except that the toner particles (5) are used instead of the toner particles (1).

Production of Developer (5)

A developer (5) is obtained in the same operations as in the production of developer (1) except that the toner (5) is used instead of the toner (1).

Example 6

Production of Toner Particles (6)

Toner particles (6) having a volume average particle size of 6.0 μm are obtained in the same operations as in the production of the toner particles (1) except that 65.9 parts of crystalline polyester resin dispersion (4) is used instead of the crystalline polyester resin dispersion (1).

Production of Toner (6)

A toner (6) is obtained in the same operations as in the production of the toner (1) except that the toner particles (6) are used instead of the toner particles (1).

Production of Developer (6)

A developer (6) is obtained in the same operations as in the production of developer (1) except that the toner (6) is used instead of the toner (1).

Comparative Example 1

Production of Toner Particles (7)

Toner particles (7) having a volume average particle size of 6.0 μm are obtained in the same operations as in the production of the toner particles (1) except that 70.6 parts of crystalline polyester resin dispersion (5) is used instead of the crystalline polyester resin dispersion (1).

Production of Toner (7)

A toner (7) is obtained in the same operations as in the production of the toner (1) except that the toner particles (7) are used instead of the toner particles (1).

Production of Developer (7)

A developer (7) is obtained in the same operations as in the production of developer (1) except that the toner (7) is used instead of the toner (1).

Comparative Example 2

Production of Toner Particles (8)

Toner particles (8) having a volume average particle size of 6.0 μm are obtained in the same operations as in the production of the toner particles (1) except that 64.1 parts of crystalline polyester resin dispersion (6) is used instead of the crystalline polyester resin dispersion (1).

Production of Toner (8)

A toner (8) is obtained as in the same operations as in the production of the toner (1) except that the toner particles (8) are used instead of the toner particles (1).

Production of Developer (8)

A developer (8) is obtained in the same operations as in the production of developer (1) except that the toner (8) is used instead of the toner (1).

Comparative Example 3

Production of Toner Particles (9)

Toner particles (9) having a volume average particle size of 6.0 μm are obtained in the same operations as in the production of the toner particles (1) except that 61.2 parts of crystalline polyester resin dispersion (7) is used instead of the crystalline polyester resin dispersion (1).

Production of Toner (9)

A toner (9) is obtained in the same operations as in the production of the toner (1) except that the toner particles (9) are used instead of the toner particles (1).

Production of Developer (9)

A developer (9) is obtained in the same operations as in the production of developer (1) except that the toner (9) is used instead of the toner (1).

Differential Scanning Calorimetry

Figure 3:
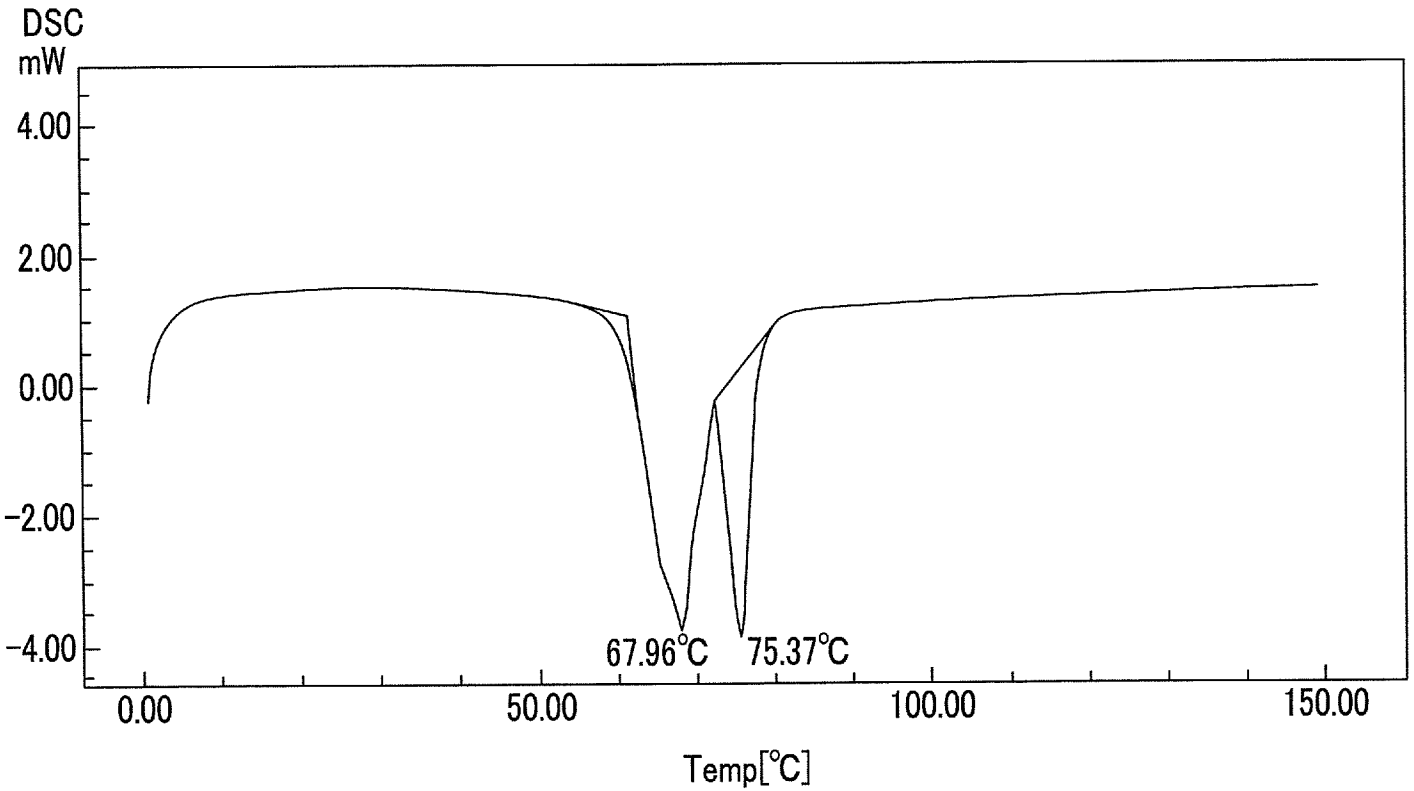
FIG. 3 shows a DSC curve which is measured during a first temperature rise in Example.
Figure 4:
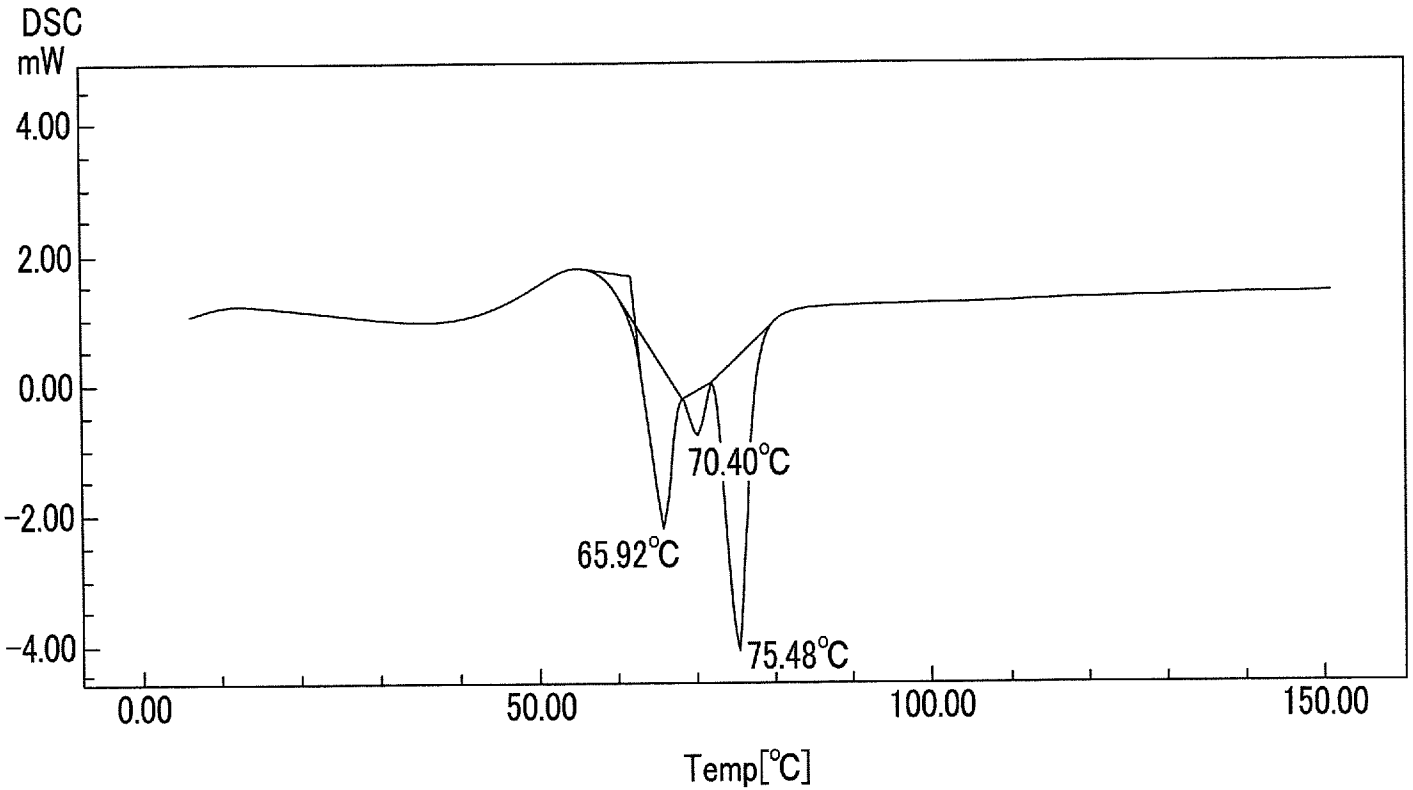
FIG. 4 shows a DSC curve which is measured during a second temperature rise in Example.

Differential scanning calorimetry (DSC) is performed by the above-described method. FIG. 3 shows a DSC curve during the first temperature rise and FIG. 4 shows a DSC curve during the second temperature rise.

Evaluation Tests

Low-temperature Fixing Property Test

As an apparatus for preparing an evaluation sample, Docu Centre Color 400 manufactured by Fuji Xerox Co., Ltd. is used. A developer unit of a color copying machine Docu Centre Color 400 (manufactured by Fuji Xerox Co., Ltd.) from which a fuser is taken out is filled with the obtained developer, and the amount of toner applied is adjusted to 0.45 $mg/cm^2$, and a non-fixed image is printed out. The printed image is a solid image of a 50 mm×50 mm size of which an image density is 100% and JD Coat 157 paper of A4 size (basis weight: 157 gsm), manufactured by Fuji Xerox Inter-Field Co., Ltd. is used as a recording medium. In the fixation of an image, the fuser taken out from the Docu Centre Color 400, manufactured by Fuji Xerox Co., Ltd., is modified to change the temperature of the roller of the fuser and the non-fixed image is fixed at a paper feeding rate of the fuser of 220 mm/sec while changing the temperature of the fuser from 110° C. to 200° C. at an interval of 5° C., whereby fixed images are obtained. The fixed image portions are folded by weight and the lowest fixing temperature is evaluated depending on degrees of image defect of the portions.

Image Defect Evaluation Test of Toner Image After Fixing

As an apparatus for preparing an evaluation sample, Docu Centre Color 400 manufactured by Fuji Xerox Co., Ltd. is used. The developer unit is filled with the obtained developer and JD Coat 157 paper of A4 size (basis weight: 157 gsm), manufactured by Fuji Xerox InterField Co., Ltd. is used as a recording medium. Printing with a high image density (the amount of toner applied at a density of 100%: 110 $g/m^2$) is continuously performed under the environment of 25° C. and 50 RH %, and 100 pieces of print paper are discharged on the same discharge tray to be left for 1 hour in a stacked state.

Then, an image defect in the fixed images on 51th sheet of the discharged paper in which an image defect is most likely to occur in terms of an amount of latent heat and pressure is evaluated.

Evaluation Criterion

G1: It is difficult to determine an image defect visually.

G2: An image defect is greater than that of G1 but minor, which is allowable.

G3: An image defect is greater than that of G2, which is allowable.

G4: An image defect is greater than that of G3, which is allowable.

G5: An image defect is severe and the degree of image quality deterioration is not allowable.

TABLE 1

| | First temperature rise | | Second temperature rise | | Difference between melting temperatures | Evaluation results | | |
|---|---|---|---|---|---|---|---|---|
| | Endothermic peak (1) | Exothermic peak of 0.1 J/g or more | Exothermic peak (2) | Difference between exothermic peak (2) and endothermic peak (1) | of crystalline polyester and release agent | Lowest fixing temperature | Low-temperature fixing properties | Image defect evaluation |
| Example 1 | Presence | Absence | Presence | 10.1° C. | 3° C. | 110° C. | ○ | G1 |
| Example 2 | Presence | Absence | Presence | 10.1° C. | 4° C. | 110° C. | ○ | G2 |
| Example 3 | Presence | Absence | Presence | 10.1° C. | 6.5° C. | 115° C. | ○ | G3 |
| Example 4 | Presence | Absence | Presence | 10.1° C. | 11° C. | 115° C. | ○ | G4 |
| Example 5 | Presence | Absence | Presence | 5.3° C. | 2° C. | 110° C. | ○ | G2 |
| Example 6 | Presence | Absence | Presence | 14.6° C. | 2° C. | 110° C. | ○ | G2 |
| Comparative Example 1 | Presence | Absence | Absence | — | 2° C. | 110° C. | ○ | G5 |
| Comparative Example 2 | Presence | Absence | Presence | 4.5° C. | 2° C. | 110° C. | ○ | G5 |
| Comparative Example 3 | Presence | Absence | Presence | 16.3° C. | 2° C. | 110° C. | ○ | G5 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

an amorphous polyester resin and a crystalline polyester resin as a binder resin, wherein:

by differential scanning calorimetry, which undergoes processes of a first temperature rise, cooling at a rate of −10° C./min and a second temperature rise, an endothermic peak (1) derived from a resin in which at least the amorphous polyester resin and the crystalline polyester resin are compatible is present in the first temperature rise, an exothermic peak having an intensity of 0.1 J/g or more is not present during the first temperature rise, and at least one exothermic peak (2) is present in a temperature range which is lower than that of the endothermic peak (1) by from 5° C. to 15° C. during the second temperature rise, and the electrostatic charge image developing toner has a core and shell structure.

2. The electrostatic charge image developing toner according to claim 1, wherein the crystalline polyester resin is a dehydrated polycondensate of aliphatic dicarboxylic acid having a carbon number of from 8 to 12 and aliphatic diol having a carbon number of from 6 to 12.

3. The electrostatic charge image developing toner according to claim 1, further comprising:

a release agent, wherein an absolute value of difference in a melting temperature of the crystalline polyester resin and a melting temperature of the release agent is 10° C. or less.

4. The electrostatic charge image developing toner according to claim 1, further comprising:

an additive that promotes separation of the crystalline polyester resin.

5. The electrostatic charge image developing toner according to claim 4, wherein the additive that promotes separation is sorbitan fatty acid ester.

6. The electrostatic charge image developing toner according to claim 4, wherein the additive that promotes separation is any one of sorbitan monostearate and behenic monostearate.

7. The electrostatic charge image developing toner according to claim 4, wherein an added amount of the additive that promotes separation is from 0.1% by weight to 3.0% by weight with respect to the crystalline polyester resin.

8. The electrostatic charge image developing toner according to claim 1, wherein a weight average molecular weight (Mw) of the amorphous polyester resin is from 5,000 to 1,000,000.

9. The electrostatic charge image developing toner according to claim 1, wherein a molecular weight distribution Mw/Mn of the amorphous polyester resin is from 1.5 to 100.

10. The electrostatic charge image developing toner according to claim 1, wherein a melting temperature of the crystalline polyester resin is from 50° C. to 100° C.

11. The electrostatic charge image developing toner according to claim 1, further comprising:

a colorant, wherein a content of the colorant is from 1% by weight to 30% by weight with respect to a total amount of the toner particles.

12. The electrostatic charge image developing toner according to claim 1, wherein a shape factor SF1 is from 110 to 150.

13. The electrostatic charge image developing toner according to claim 1, wherein a glass transition temperature (Tg) of the amorphous polyester resin is from 50° C. to 80° C.

14. An electrostatic charge image developer including the electrostatic charge image developing toner according to claim 1.

15. A toner cartridge that accommodates the electrostatic charge image developing toner according to claim 1, and is detachable from an image forming apparatus.

* * * * *